US008484826B2

(12) United States Patent
Kemmer et al.

(10) Patent No.: US 8,484,826 B2
(45) Date of Patent: Jul. 16, 2013

(54) APPARATUS AND METHOD FOR INSTALLING CONNECTING RODS

(75) Inventors: Brent Kemmer, Clarkston, MI (US); Marc L. Huffman, Clarkston, MI (US); Scott M. Kociba, Clarkston, MI (US); Christopher W. Zwolensky, Grand Blanc, MI (US); Quintin A. Wilson, Commerce, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 425 days.

(21) Appl. No.: 12/951,756

(22) Filed: Nov. 22, 2010

(65) Prior Publication Data

US 2011/0061220 A1 Mar. 17, 2011

Related U.S. Application Data

(62) Division of application No. 11/843,153, filed on Aug. 22, 2007, now Pat. No. 7,836,571.

(51) Int. Cl.
*B25B 11/00* (2006.01)

(52) U.S. Cl.
USPC ..... 29/559; 29/281.1

(58) Field of Classification Search
USPC ..... 29/559, 281.1, 281.5, 281.3; 269/32, 269/228
See application file for complete search history.

(56) References Cited

U.S. PATENT DOCUMENTS

| | | | | |
|---|---|---|---|---|
| 3,872,760 | A | 3/1975 | Desnoyers, Jr. | |
| 4,480,368 | A | 11/1984 | Vachon | |
| 4,936,163 | A | 6/1990 | Hoag | |
| 5,105,538 | A | 4/1992 | Hoag | |
| 5,941,515 | A | 8/1999 | Salow | |
| 6,116,588 | A | 9/2000 | Yamane | |
| 6,609,299 | B2 | 8/2003 | Adachi | |
| 6,782,609 | B1 | 8/2004 | Beggs | |
| 6,954,972 | B2 | 10/2005 | Hamilton | |
| 7,152,293 | B2 | 12/2006 | Abrahamson | |
| 7,648,132 | B2 | 1/2010 | Hediger | |
| 7,836,571 | B2 * | 11/2010 | Kemmer et al. | 29/281.1 |
| 2009/0049618 | A1 * | 2/2009 | Kemmer et al. | 7/100 |
| 2011/0061220 | A1 * | 3/2011 | Kemmer et al. | 29/281.1 |

* cited by examiner

*Primary Examiner* — Lee D Wilson

(57) ABSTRACT

An apparatus and method for installing a piston and connecting rod assembly in a cylinder of an engine block includes a frame, an installation rod and a guide defining a channel complementary to the rod. The frame is disposed about an opening at the bottom of the engine block and the guide is positioned on the frame in alignment with a cylinder. The installation rod is coupled to the connecting rod and the rod and the piston and connecting rod assembly are slid into the cylinder. The installation rod is received within the guide channel and maintains the connecting rod perpendicular to the crankshaft and away from the cylinder wall. As the connecting rod moves toward the crankshaft, the guide and rod move the connecting rod into proper alignment and contact with the crankshaft.

17 Claims, 4 Drawing Sheets

APPARATUS AND METHOD FOR INSTALLING CONNECTING RODS

CROSS-REFERENCE TO RELATED APPLICATIONS

This application is a divisional of U.S. application Ser. No. 11/843,153 filed Aug. 22, 2007 now U.S. Pat. No. 7,836,571. The disclosure of the above application is incorporated herein by reference.

FIELD OF THE INVENTION

The invention relates to an apparatus and method for installing connecting rods in engines and more particularly to a method and apparatus for installing a piston and connecting rod assembly on the crankshaft of an internal combustion engine.

BACKGROUND

Installation of connecting rods and piston assemblies in the cylinders of internal combustion engines is an exacting and labor intensive process. First of all, the connecting rod and piston skirt must be carefully aligned with the cylinder. The assembly is then slid axially into the cylinder. Throughout this step, it is vital that the connecting rod not contact the wall of the cylinder to avoid damaging it. Also at this time, it is necessary to radially compress the piston rings in order to slide the piston into the cylinder. As the connecting rod bearing approaches the crankshaft, it must accurately align with the corresponding crankshaft portion so that it may be mated therewith, preferably on the first approach. Again, it is necessary to ensure that no other portion of the connecting rod except the bearing portion contacts the crankshaft in order to avoid damaging it.

Various approaches to the problem of installing pistons and connecting rods are revealed in the prior art.

In U.S. Pat. No. 4,480,363 a novel solution is offered for the repair of a damaged piston/cylinder which involves the replacement of the entire cylinder liner, piston and connecting rod assembly. Utilizing this preassembled package, it is argued, speeds and simplifies the repair process.

U.S. Pat. No. 6,609,299 focuses on the installation of sleeve bearings in the connecting rod before it is mounted to an engine crankshaft.

An installation tool which takes the approximate form of a connecting rod end cap is disclosed in U.S. Pat. No. 6,954,972. The tool protects the bearing surface during assembly and attachment of a connecting rod to a crankshaft.

Upon a review of the foregoing discussion and prior art, it is apparent that improvements in the art of connecting rod and piston installation are desirable.

SUMMARY

An apparatus for installing a piston and connecting rod assembly in a cylinder of an engine block of an internal combustion engine includes a frame, an installation rod and an installation guide defining a channel complementary to the rod. A method of utilizing the apparatus is also disclosed. The apparatus and method have applicability for the installation of cracked connecting rods, i.e., those rods having end caps fractured from the main body of the connecting rod as well as conventional connecting rods having machined mating surfaces between the connecting rod and the end cap. In the method, the frame is disposed about an opening at the bottom of an engine block and the guide is positioned on the frame in alignment with a cylinder. The installation rod is coupled to the connecting rod and the installation rod and the piston and connecting rod assembly are slid into the cylinder. The installation rod is received within the channel in the guide and maintains the connecting rod perpendicular to the crankshaft and away from the cylinder wall. As the connecting rod moves toward the crankshaft, the guide and installation rod move the connecting rod into proper alignment and contact with the crankshaft. The end cap and securing bolts may then be installed.

An aspect of the present invention provides a method of installing piston and connecting rod assemblies into the cylinders of internal combustion engines.

Another aspect of the present invention provides a method of installing cracked connecting rod and piston assemblies into the cylinders of internal combustion engines.

Further aspects of the present invention will become apparent by reference to the following description and appended drawings wherein like reference numbers refer to the same component, element or feature.

DRAWINGS

FIG. 1 is a perspective view in partial section of a portion of an internal combustion engine block and the connecting rod installation apparatus according to the present invention;

FIG. 1A in an enlarged, full sectional view of an end portion of an installation rod according to the present invention taken along line 1A-1A of FIG. 1;

DETAILED DESCRIPTION

Figures 1, 1A:
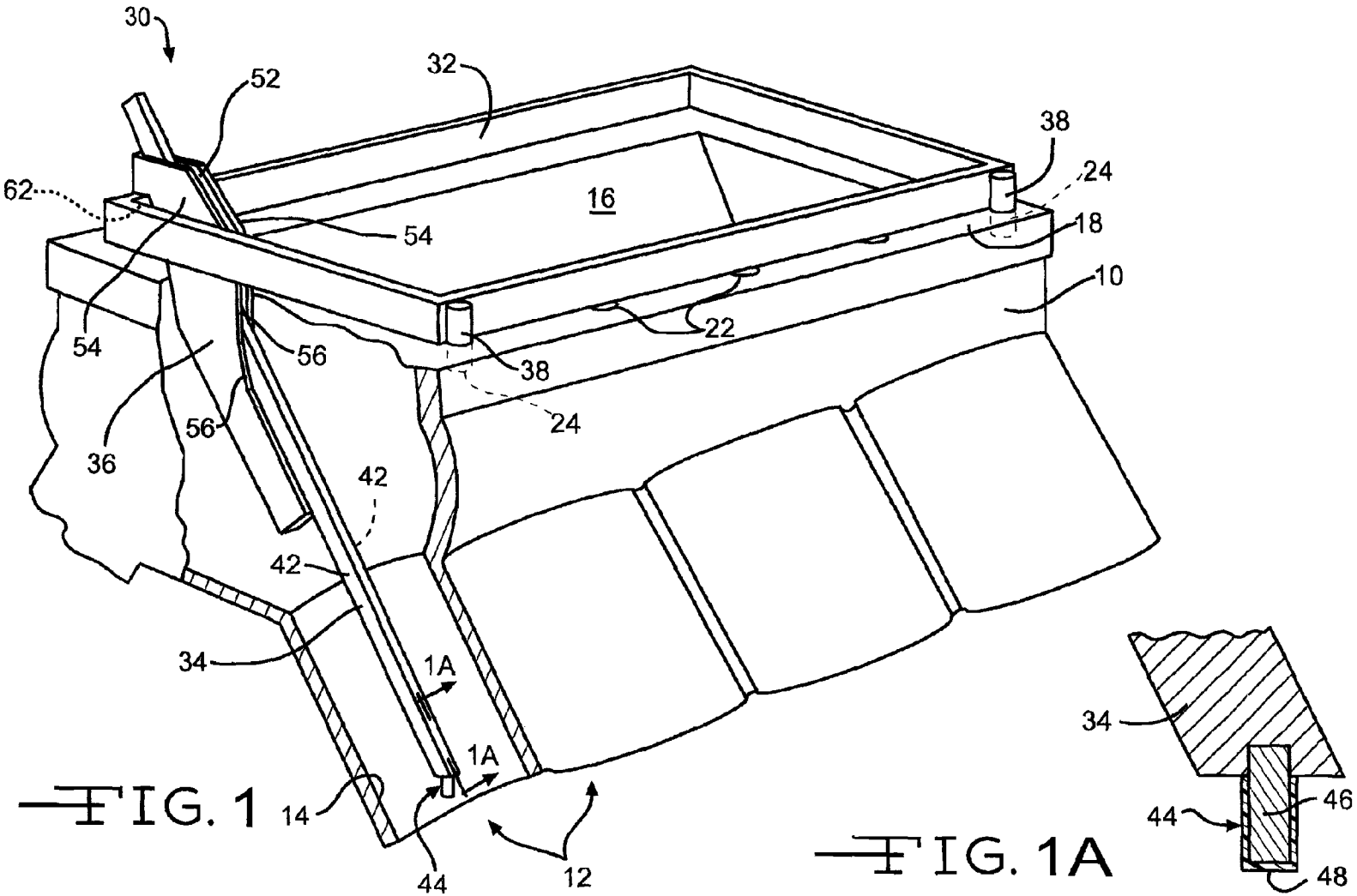

Referring now to FIG. 1, a portion of an internal combustion engine block is illustrated and designated by the reference number 10. The engine block 10 is a large, complex metal casting having, among other features, passageways, openings and machined surfaces which receive, support and secure various components of the internal combustion engine. It will be appreciated that, as illustrated and during the subsequently described installation process, the engine block 10 is preferably disposed in an inverted orientation that facilitates use of the apparatus and practice of the method of the present invention. The engine block 10 includes a plurality of cylinders 12, typically defined by cylinder liners 14. In its inverted orientation, the engine block 10 defines an upwardly facing opening 16 about which extends a planar, machined surface or flange 18. A gasket and oil pan (both not illustrated) will be secured to the planar surface or flange 18 by a plurality of threaded fasteners (not illustrated) received within a like plurality of blind, threaded openings 22. Preferably, the machined surface or flange 18 also includes at least two spaced-apart locating holes or bores 24.

A connecting rod installation apparatus 30 according to the present invention includes the following components: a rigid, typically rectangular frame 32, an elongate installation rod 34 and an installation guide 36.

The rectangular frame 32 may be fabricated from either a hollow box beam or a solid bar and defines a length and width slightly larger than the length and width of the opening 16 in the bottom of the engine block 10. Though characterized as rectangular, which will typically be its shape, the frame 32 may be any shape which matches or corresponds to the shape of the flange 18 on the engine block 10 with which it will be used. The frame 32 includes at least two pins or lugs 38 which are arranged to align with and are received within the locating holes or bores 24 in the flange 18 of the engine block 10.

As illustrated in FIGS. 1 and 1A, the elongate installation rod 34 is a straight, preferably metal bar or rod defining opposed, parallel flats 42. Thus, the installation rod 34 may be rectangular, as illustrated, or square, hexagonal or octagonal, for example. At one end of the installation rod 34 is an engagement pin 44. The engagement pin 44 includes a rigid, preferably metal, center post 46 seated and secured in the installation rod 34 and coated or encased on its sides and end in a covering or layer 48 of a stiffly resilient material such as nylon or polyethylene.

Figure 2:
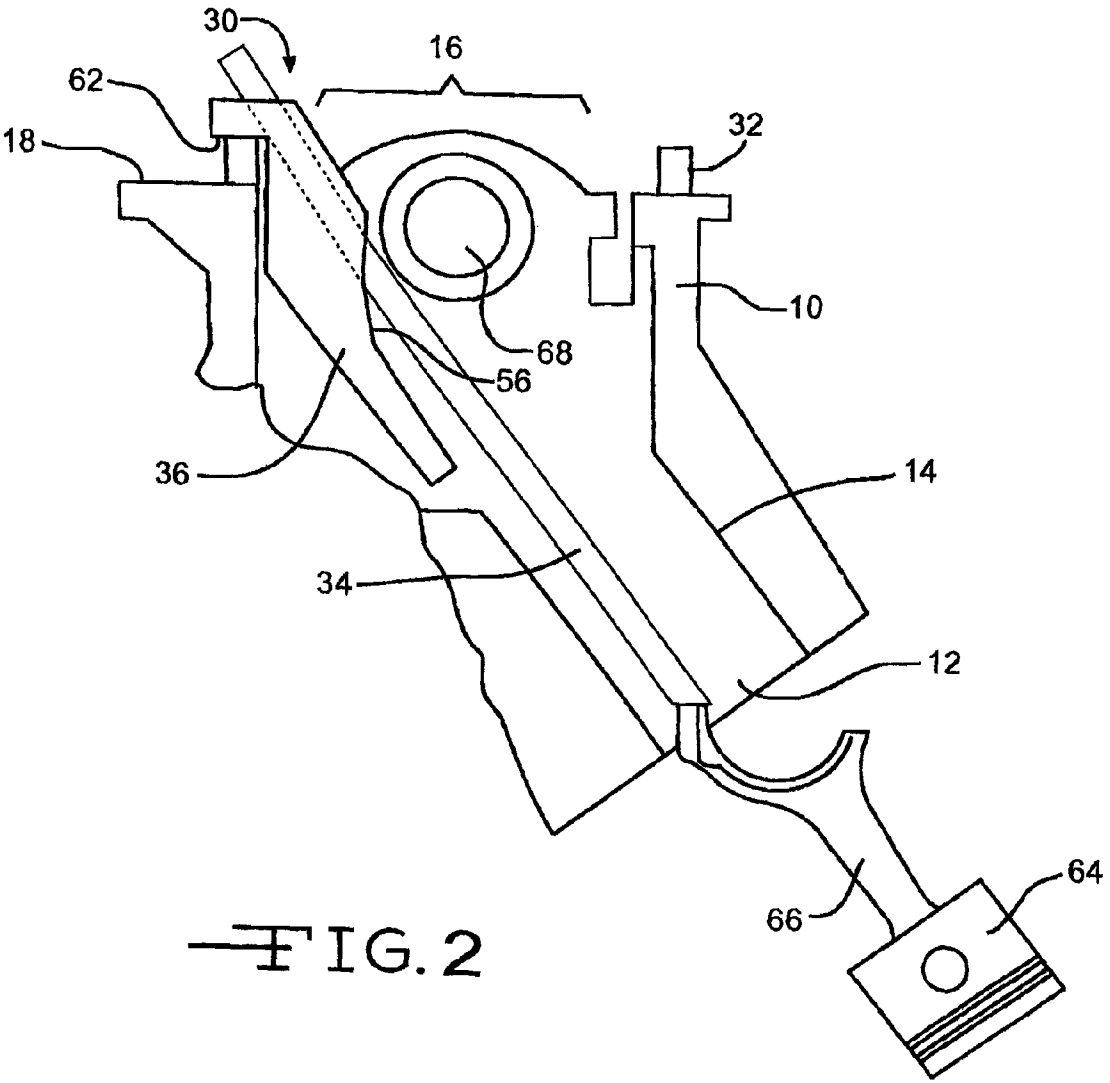
FIG. 2 is a diagrammatic view of the connecting rod installation apparatus according to the present invention at the beginning of the installation process.

As illustrated in FIGS. 1A and 2, the engagement pin 44 is oriented relative to the longitudinal axis of the installation rod 34 such that when assembled to a connecting rod 66, the installation rod 34 extends along an axis substantially parallel to the longitudinal axis of the connecting rod 66. For example, if the mating surfaces of the end cap (not illustrated) and the connecting rod 66 are disposed at a 45 degree angle to the longitudinal axis of the connecting rod 66, the engagement pin 44 will be oriented at or approximately at a corresponding 45 degree angle so that the longitudinal axes of the installation rod 34 and the connecting rod 66 are parallel or substantially so. Similarly, if the mating surfaces of the end cap and the connecting rod 66 are perpendicular to the longitudinal axis of the connecting rod 66, the engagement pin 44 will be oriented parallel or approximately parallel to the longitudinal axis of the installation rod 34. Intermediate angles of the mating surfaces of the end cap and the connecting rod 66 will be accommodated, of course, by corresponding angular orientation of the engagement pin 44 relative to the longitudinal axis of the installation rod 34.

Referring now to FIGS. 1 and 2, the installation guide 36 is generally U-shaped and defines a through slot or channel 52 defined by parallel, spaced-apart sidewalls 54. The channel 52 has a width just slightly larger than the distance between the flats 42 of the installation rod 34 so that it will freely, slidingly receive it while preventing it from rotating relative to the guide 36. The sidewalls 54 together define a bifurcated front surface or face 56. The two portions of the front surface or face 56 formed by the sidewalls 54 are preferably parallel. The front surfaces 56 are generally arcuate or curved and are shaped to urge a connecting rod into proper alignment and contact with a crankshaft as will be more fully described subsequently. Finally, the installation guide 36 includes a flat bearing surface 62 which is adapted to rest on the top surface of the rectangular frame 32 and properly position and retain the installation guide 36 on the engine block 10.

Figure 3:
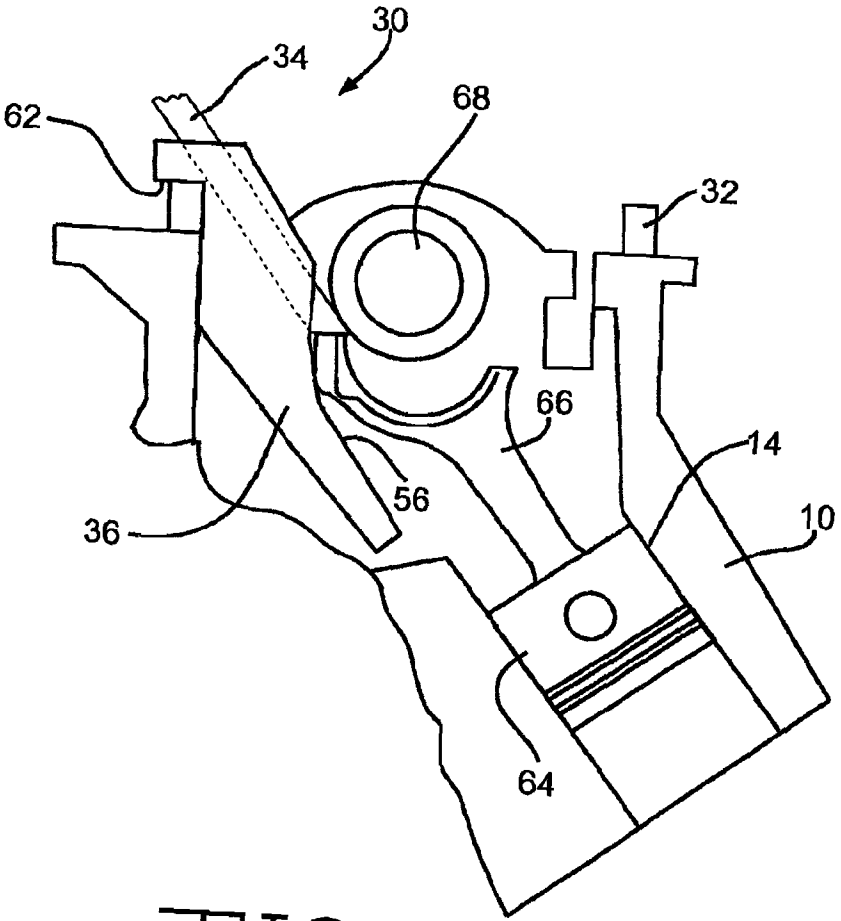
FIG. 3 is a diagrammatic view of the connecting rod installation apparatus according to the present invention during the installation process.
Figure 4:
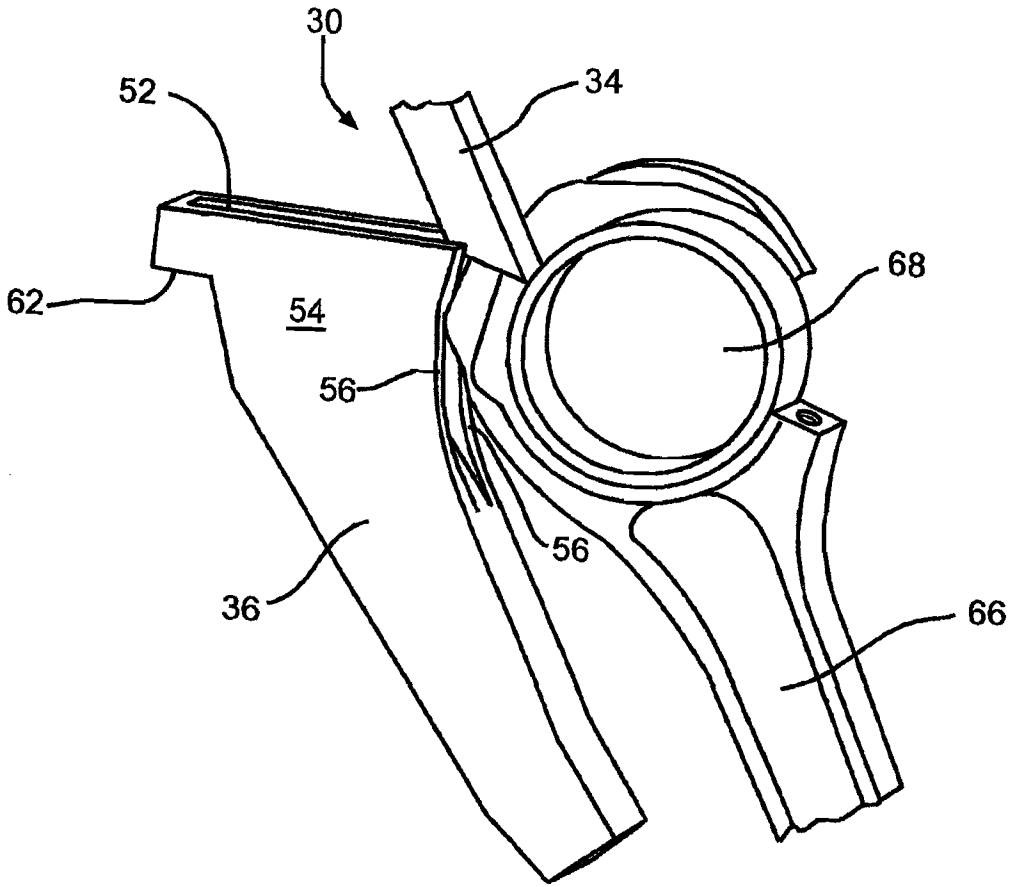
FIG. 4 is a perspective view of the connecting rod installation apparatus according to the present invention at the end of the installation process.

Referring now to FIGS. 2, 3 and 4, the installation of a connecting rod and piston assembly onto a crankshaft in an engine block 10 utilizing the connecting rod installation assembly 30 will now be described. As illustrated in FIG. 2, the elongate installation rod 34 is secured to a connecting rod 66 by pushing the engagement pin 44 into a threaded opening, one of which is illustrated in FIG. 4. The connecting rod 66 (with bearing shell installed) is, of course, assembled to a piston 64 which includes piston rings and is ready for installation in a cylinder 12. At this time, the rectangular frame 32 is installed on the machined surface or flange 18 by inserting the pins or lugs 38 into the locating holes or bores 24. The installation guide 36, and particularly the bearing surface 62, is placed on the upper surface of the rectangular frame 32 in alignment with one of the cylinders 12. The piston 64, the connecting rod 66 and the installation rod 34 are then aligned with the cylinder 12 and slid axially thereinto. As the installation rod 34 approaches the installation guide 36, it is aligned with and slid through the slot 52.

As illustrated in FIG. 3, the installation continues as the piston 64 enters the cylinder 12, the bearing surface of the connecting rod 66 approaches the crankshaft 68 and the portion of the yoke of the connecting rod 66 secured to the installation rod 34 engages the curved surfaces 56 of the installation guide 36.

As illustrated in FIG. 4, installation of the piston 64 and connecting rod 66 on the crankshaft 68 is essentially complete. Contact between the curved surfaces 56 of the installation guide 36 and the exterior of the side of the yoke of the connecting rod 64 secured to the installation rod 34 urges the connecting rod 66 and more specifically the bearing surface of the connecting rod 66 into accurate and proper alignment and contact with the corresponding bearing surface on the crankshaft 68. Finally, the installation rod 34 may be removed and, while maintaining the assembled position of the connecting rod 66 and crankshaft 68, an end cap (not illustrated) may be secured to the connecting rod 66 by threaded fasteners such as bolts.

It will be appreciated that installation of a piston 64 and a connecting rod 66 assembly into a cylinder 12 in accordance with the present invention is rapid and essentially foolproof. Additionally, it maintains the connecting rod 66 away from the wall of the cylinder liner 14 and brings the connecting rod 66 into proper alignment and contact with the crankshaft 68 thereby avoiding damage by impact or scoring to both of these components.

The description of the invention is merely exemplary in nature and variations that do not depart from the gist of the invention are intended to be within the scope of the invention. Such variations are not to be regarded as a departure from the spirit and scope of the invention.

We claim:

1. A method of installing a connecting rod on a crankshaft in an engine block, the method comprising:

positioning a frame on the engine block;

providing an installation guide having a guiding surface with a predetermined profile selected to position the connecting rod onto the crankshaft during installation of the connecting rod;

engaging the installation guide with the frame;

aligning the installation guide with a cylinder of the engine block to position the guiding surface opposite the crankshaft;

inserting the connecting rod into the cylinder; and sliding the connecting rod along the guiding surface of the installation guide until the connecting rod is positioned on the crankshaft.

2. The method of claim 1 further including engaging an installation member with the connecting rod.

3. The method of claim 2 further including sliding the installation member at least partially through a guiding groove of the installation guide and at least partially through the cylinder.

4. The method of claim 3 wherein engaging the installation member with the connecting rod further includes inserting a pin of the installation member into an aperture defined by the connecting rod, wherein the pin is disposed at an end of the installation member and is oriented at an angle with respect to a main portion of the installation member.

5. The method of claim 1 wherein sliding the connecting rod further includes sliding the connecting rod towards the crankshaft until the guiding surface of the installation guide has guided the connecting rod into engagement with the crankshaft, and wherein the guiding surface of the installation guide is curved.

6. The method of claim 1 further including disengaging the installation member from the connecting rod.

7. The method of claim 1 wherein positioning the frame further includes inserting a plurality of pins fixedly attached to the frame into a plurality of apertures defined by the engine block.

8. A method of installing a connecting rod on a crankshaft in an engine block, the method comprising:

positioning a frame on the engine block;

providing an installation guide having a guiding surface with a predetermined profile selected to position the connecting rod onto the crankshaft during installation of the connecting rod;

engaging the installation guide with the frame;

aligning the installation guide with a cylinder of the engine block to position the guiding surface opposite the crankshaft;

sliding an installation member at least partially through a guiding groove of the installation guide and at least partially through the cylinder;

engaging the installation member with the connecting rod;

moving the connecting rod into the cylinder towards the crankshaft; and sliding the connecting rod along the guiding surface of the installation guide until the connecting rod is positioned on the crankshaft.

9. The method of claim 8 further including disengaging the installation member from the connecting rod.

10. The method of claim 8 wherein engaging the installation member with the connecting rod further includes inserting a pin of the installation member into an aperture defined by the connecting rod, wherein the pin is disposed at an end of the installation member and oriented at an angle with respect to a main portion of the installation member.

11. The method of claim 8 further including moving the connecting rod into the cylinder towards the crankshaft until the guiding surface of the installation guide has guided the connecting rod into engagement with the crankshaft, wherein the guiding surface is curved.

12. The method of claim 8 wherein positioning the frame includes inserting a plurality of pins fixedly attached to the frame into a plurality of apertures defined by the engine block.

13. A method of installing a piston and connecting rod assembly in a cylinder of an engine block, the method comprising:

attaching a frame to a bottom opening of the engine block;

positioning a guide having a channel on the frame so that the channel is aligned with a cylinder of the engine block;

attaching an installation rod to an aperture in the connecting rod;

sliding the installation rod into the guide;

sliding the connecting rod and piston assembly into the cylinder; and guiding the connecting rod into engagement with a bearing surface of a crankshaft.

14. The method of claim 13 wherein guiding the connecting rod into engagement with a bearing surface of a crankshaft includes translating the connecting rod along a surface of the guide.

15. The method of claim 13 further including the step of sliding the connecting rod and piston assembly along at least one curved surface on the guide.

16. The method of claim 13 further including the step of removing the installation rod from the connecting rod.

17. The method of claim 13 further including the step of securing the connecting rod to the crankshaft.

* * * * *